US008101839B1

(12) United States Patent
KauFman

(10) Patent No.: US 8,101,839 B1
(45) Date of Patent: Jan. 24, 2012

(54) CAPO FOR STRINGED INSTRUMENTS

(76) Inventor: Jay Stephen KauFman, Kingston, NH (US)

( * ) Notice: Subject to any disclaimer, the term of this patent is extended or adjusted under 35 U.S.C. 154(b) by 0 days.

(21) Appl. No.: 12/803,945

(22) Filed: Jul. 12, 2010

(51) Int. Cl.
*G10D 3/14* (2006.01)

(52) U.S. Cl. ..... 84/312 R

(58) Field of Classification Search ..... 84/312 R, 84/313, 315, 318
See application file for complete search history.

(56) References Cited

U.S. PATENT DOCUMENTS 3,339,446 A * 9/1967 Gantz ..... 84/456

* cited by examiner

*Primary Examiner* — Kimberly Lockett

(57) ABSTRACT

A sliding capo for rapid changing of the pitch of musical instrument strings. The capo comprises a bar assembly for extending across and engaging the strings on the neck of an instrument, and a spring assembly connected to opposite ends of the bar assembly and extending across the back of the neck of the instrument for pulling the strings into contact with the frets of the instrument.

12 Claims, 2 Drawing Sheets

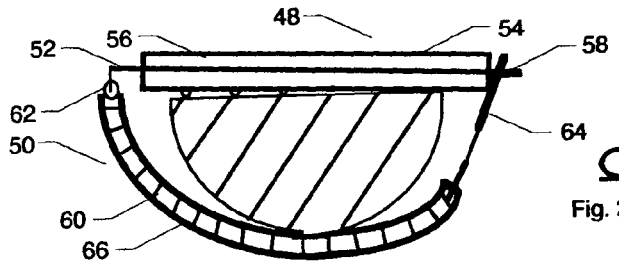
Fig. 2
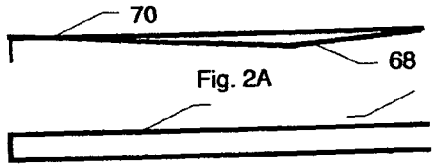
Fig. 2A
Fig. 2C
Fig. 2B
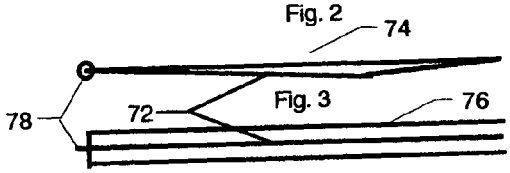
Fig. 3
Fig. 3A
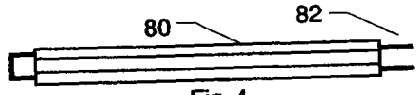
Fig. 4
Fig. 4A
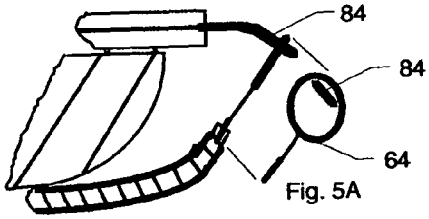
Fig. 5A
Fig. 5
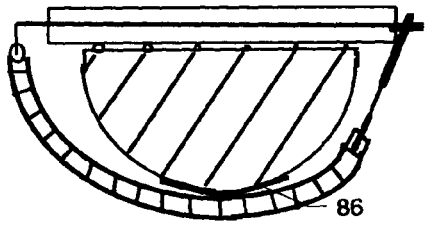
Fig. 6
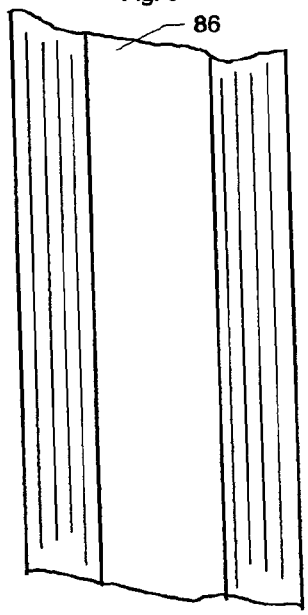
Fig. 6A

CAPO FOR STRINGED INSTRUMENTS

BACKGROUND OF THE INVENTION

The present invention relates to attachments for stringed instruments and pertains particularly to an improved capo for fretted stringed instruments. In use the capo enables rapid key changes. It is frequently desirable to raise the pitch of the strings of fretted stringed musical instruments which is typically accomplished by means of a device called a capo. A capo comprises a bar which is clamped across the strings for pulling the strings to the frets which are embedded in the fingerboard or neck of the instruments. This shortens the effective vibrating length of the strings, thereby raising the pitch thereof. The capo is moved to various fret locations along the finger board for selectively raising the pitch of the instrument. Relatively large forces are required to simultaneously clamp all strings with a straight rigid bar due to the adverse profile imposed by the tops of strings of different diameter in contact with frets which may vary in profile across the width of the fingerboard. Several devices have been devised to increase the clamping force to effectively clamp the strings to the frets. These prior art devices, however, are unwieldy, require unusual manual dexterity to use, and must be removed or loosened to change position along the finger board and then re-tightened. When not in use, they are temporarily attached to the instrument away from the strings or removed from the instrument. In my prior capo patent I disclosed an improved capo having a flexible bar assembly with a full wear sleeve that progressively applies pressure to the strings by force of a spring in a low friction spring sheath to bias them to add force against the frets. Problems with the design of my prior capo are; loss of force applied by the bar to the strings near the center of a fingerboard having a flat profile during flexure of the bar assembly, excessive effect of wear sleeve stiffness on flexure of the bar, difficulty to stretch the spring during assembly of the capo to the instrument and potentially insufficient wear resistance of the spring sheath. I have discovered further improvements in component configuration that resolve these problems and are incorporated herein. It is desirable that the capo be capable of uniform application of force to all of the strings against the frets, and be simple and easy to move to selected locations along the neck of the instrument.

SUMMARY AND OBJECTS OF THE INVENTION

It is the primary object of the present invention to provide an improved capo for fretted stringed instruments. In accordance with a primary aspect of the present invention, a capo for raising the pitch of strings of a stringed musical instrument comprises a bar assembly and a spring assembly. The bar assembly comprises a wire form for extending across the strings of the instrument, an elastically deformable underlayment tube with an outer wear sleeve for sheathing the wire form, and a tip sleeve over one end of the wire form. The spring assembly comprises a coil extension spring connected to opposite ends of the bar assembly and extending across the back of the neck of the instrument for pulling the bar assembly into engagement with the strings and the strings into engagement with the frets of the instrument, a low friction spring sheath for extending over the spring while encircling the neck of the instrument, and at least one eye screw for adjustably connecting the spring to the bar assembly.

In accordance with still another aspect of the present invention, application of a split wear sleeve reduces the effect of wear sleeve stiffness on flexure of the bar assembly, thus improving flexure control by suitable calibration of the wire form configuration.

In accordance with still another aspect of the present invention, an aide for installation of the capo to the instrument neck comprises a tailpiece part of the bar assembly for stretching the spring by pulling the eye of the eye screw into engagement with an end of the bar assembly.

In accordance with a final aspect of the present invention, application of a length of low friction adhesive tape adhered along the underside of the neck of the instrument reduces sliding friction of the capo and wear of the neck.

BRIEF DESCRIPTION OF THE DRAWING

The above and other objects and advantages of the present invention will become apparent from the following description when read in conjunction with the accompanying drawings wherein:

FIG. 2 is a front elevation section view illustrating a preferred embodiment of the capo portion of the present invention in relation to the neck of a stringed musical instrument;

FIG. 2A is a front elevation view of the wire form of FIG. 2;

FIG. 2B is a top plan view of the wire form of FIG. 2;

FIG. 2C is an end view of the wire form of FIG. 2;

FIG. 3 is a front elevation view illustrating an alternate embodiment of the wire form of the present invention;

FIG. 3A is a top plan view of the wire form of FIG. 3;

FIG. 4 is a top plan view of an alternate embodiment of the sheathed bar assembly of FIG. 2;

FIG. 4A is an end view of the sheathed bar assembly of FIG. 4.

FIG. 5 is a partial front elevation section view illustrating an alternate embodiment of the capo portion of the present invention in relation to the neck of a stringed instrument;

FIG. 5A is a projected end view of the embodiment of FIG. 2 illustrating assembly of the eye screw to the bar assembly;

FIG. 6 is a front elevation section view illustrating an alternate embodiment of the capo portion of the present invention in relation to the neck of a stringed instrument;

FIG. 6A is a bottom plan view of the embodiment of FIG. 6;

DETAILED DESCRIPTION OF PREFERRED EMBODIMENTS

Figure 1:
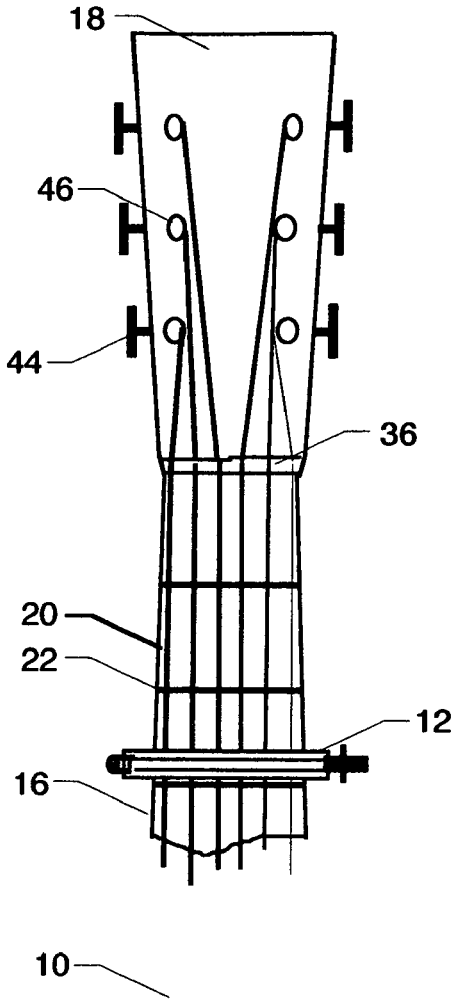
FIG. 1 is a plan view illustrating a preferred embodiment of the invention in use.
Figure 1:
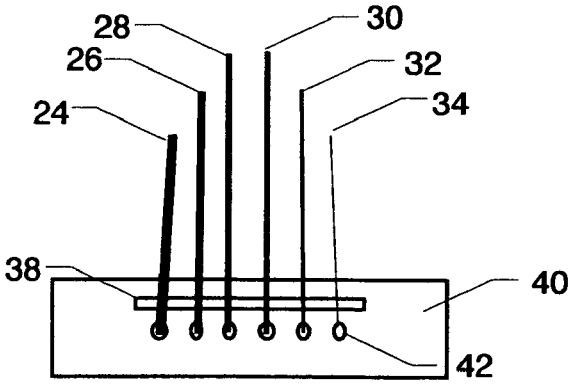

FIG. 1 is a top plan view illustrating a typical stringed instrument 10 with an exemplary embodiment of a capo 12 shown in use in accordance with the present invention. As illustrated in FIG. 1, a neck 16 of the instrument has a head 18, connected to a finger board 20 formed by a surface of the neck having a transverse profile which may vary from flat to curved among different instruments and a plurality of frets 22 (typ.) conforming to the neck profile mounted thereon in conventional spaced relation. A plurality of strings 24, 26, 28, 30, 32 and 34 are aligned by a nut 36 at one end, continue over and across the frets, and are aligned at the other end by a bridge 38 held by a saddle 40 and anchored by pins 42 (typ.). The vibrating length of the strings is determined by distance between contact points with the nut and bridge and the pitch of the strings is determined by adjustment of tuners 44 (typ.) geared to rotatable posts 46 (typ.). The variation of the transverse top of strings profile formed by the neck, fret and string diameters among different instruments adds to the difficulty with the use of prior art capos.

FIG. 2 is a cross-section view illustrating a preferred embodiment of capo 12 of the present invention. The capo comprises a bar assembly 48 and a spring assembly 50 wherein the bar assembly spans across the strings of the instrument with both ends connected adjustably to the spring assembly which extends around the neck of the instrument. The bar assembly comprises a straight wire form 52 bent as a hairpin having two parallel prongs extending from the tangent points of the one-hundred eighty degree bend of the hairpin, a full wear sleeve 54 for contact with the strings, an underlayment tube 56 disposed longitudinally between the wire form and the wear sleeve, and a tip sleeve 58 over one end of the wire form. The wire form may be constructed of any suitable material, but is preferably constructed of steel music wire. The wire form preferably has a spring rate to apply approximately 1.4 to 2.7 kg. of force to the strings, and to conform by such force to any transverse top of strings profile while applying approximately uniform force to each string during use between the first and approximately seventh fret. It will be appreciated that the neck width and depth increases from the head to the body of the instrument. This variation in cross section varies among instruments and the structure of capo 12 takes this into consideration. The underlayment tube may be constructed of any suitable material having the desired durability and durometer to accommodate indentation due to pressure from the strings. A suitable material for the underlayment tube is polyurethane tubing. The wear sleeve may be constructed of any suitable material having the desired flexibility to accommodate indentation due to pressure from the strings and the desired wear resistance to accommodate friction due to movement of the capo along the strings of the instrument. A suitable material for the wear sleeve is nylon tubing. The tailpiece may be constructed of any suitable material having the desired friction and durometer to grip the wire form while retaining connection to the spring assembly. A suitable material for the tailpiece is polyurethane tubing, The spring assembly comprises a coil extension spring 60 with a hook 62 at one end for connection to the bar assembly and an adjustable eye screw 64, threadably engaged in the spring for connection to the other end of the bar assembly by stretching of the spring. The eye screw may be threaded in or out of the spring prior to connection to the bar assembly to adjust tension in the spring. The spring may be constructed of any suitable material, but is preferably constructed of steel music wire. The spring, in accordance with a preferred embodiment of the invention, is wound with a pre-tension force of approximately 1.6 kg. to match the force requirement of the bar assembly at the first fret. The spring is sheathed by a wear resistant low friction spring tube 66 for contact with the neck. The spring tube may be constructed of any suitable material having the desired durability, friction and elasticity to accommodate movement of the capo along the neck of the instrument. A suitable material for the spring tube is teflon.

FIG. 2A is a front elevation view, FIG. 2B is a top plan view and FIG. 2C is an end view illustrating an alternate embodiment, wherein one prong 68 of a two prong wire form 70 is plastically formed into a curve at a selected longitudinal position, such that the apex of the curved prong first adds force against the strings in proximity of the center of the neck width of the instrument while both prongs provide substantially uniform force distribution across all strings of the instrument, during flexure of the bar assembly. Curvature of prong 68 is calibrated to assure application of desired force to strings near the center of a fingerboard and neck having a flat or nearly flat transverse profile.

FIG. 3A is a front elevation view and FIG. 3B is a top plan view illustrating still another alternate embodiment of the capo of the present invention, wherein a center prong 72 of a three prong wire form assembly 74 is plastically formed into a curve at a selected longitudinal position, such that the apex of the curved prong first adds force against the strings in proximity of the center of the neck width of the instrument while the three prongs provide substantially uniform force distribution across all strings of the instrument, during flexure of the bar assembly. The center prong is hinged at the bend of a hairpin 76 by a loop 78 of the center prong and extends between and parallel to the two prongs of the hairpin. Curvature of the center prong is calibrated to assure application of desired force to strings near the center of a fingerboard and neck having a flat or nearly flat transverse profile.

FIG. 4 is a top plan view and FIG. 4A is an end view illustrating an alternate embodiment, wherein a split wear sleeve 80 is provided to reduce the effect of flexural stiffness of the full wear sleeve 54 on combined flexural stiffness of the bar assembly comprised of the wear sleeve, bar and underlayment tube. The split wear sleeve is made by slitting a tube having a diameter less than that of the underlayment tube, and is then secured to the underlayment tube by the residual circumferential stress in the undersized tube while extending approximately 200 degrees around the underlayment tube. The split wear sleeve may be constructed of any suitable material having the desired flexibility to accommodate indentation due to pressure from the strings and the desired wear resistance to accommodate friction due to movement of the capo along the strings of the instrument. A suitable material for the split wear sleeve is nylon.

FIG. 5 is a partial front elevation section view and FIG. 5B is a detail of the eye screw connection end of capo 12 illustrating another alternate embodiment of the capo of the present invention, wherein a flexible tailpiece 84 attached to the end of the bar assembly is used to aide assembly of the capo to the neck of the instrument. One end of the tailpiece is passed through the eye of the eye screw and pulled in a direction away from the neck while stretching the coil extension spring to ease connection of the eye screw to the projected end of the bar. The tailpiece may be constructed of any suitable material having the desired flexibility, durability, elasticity, and friction to accommodate stretching of the spring while maintaining attachment to the bar. Suitable materials for the tailpiece are nylon string or polyurethane tubing.

FIG. 6 is a cross-section view of the capo of the present invention and FIG. 6A is a bottom plan view of the neck of the instrument illustrating an alternate embodiment, wherein spring 60 is not sheathed and wear of the neck due sliding of the capo is protected against by an elongated strip of low friction tape 86 adhered to the undersurface of the neck. The tape may be made of any suitable material having the desired friction, durability, flexibility and adhesion to accommode the sliding movement of the capo and attachment to the neck. A suitable material for the tape is ultra-high molecular weight polyethylene.

While I have illustrated and described my invention by means of specific embodiments, it is to be understood that numerous changes and modifications may be made therein without departing from the spirit and scope of the invention as defined in the appended claims.

I claim:

1. A capo for detachably mounting on the neck of a fretted stringed musical instrument having either a flat or a curved transverse finger board profile comprising: flexing bar means having at least one straight bar and at least one suitably curved bar for extending substantially in parallel across all of said strings to substantially distribute uniform force to all of said strings; spring means having adjustable connection means for adjusting the tension of said spring and connecting said spring means to said bar means while extending across the back of the neck of said instrument for pulling the strings into engagement with a selected fret of said instrument; low friction wear resistant string engagement means for extending across said strings and disposed between said bar means and said strings; and low friction wear resistant neck engagement means disposed between said spring and said neck.

2. A capo according to claim 1 wherein said straight bar is a straight prong of a hairpin wire form extending from a tangent point of a one hundred eighty degree bent end of said hairpin to an opposite open end, and said curved bar is a curved prong of said wire form extending from the other tangent point of said bent end to said open end.

3. A capo according to claim 2 wherein said curved prong has a plastically deformed curve, the apex of which first engages the strings in proximity of the center of the neck width of said instrument, while said straight prong and said curved prong flex to substantially distribute uniform force to all of said strings.

4. A capo according to claim 3 wherein said string engagement means comprises a split tube for reducing flexural stiffness of said bar means.

5. A capo according to claim 4 wherein said split tube is made of nylon.

6. A capo according to claim 1 wherein said bar means comprises a hairpin wire form having two straight prongs extending substantially in parallel from each tangent point of a one hundred eighty degree bent end to an opposite open end and one suitably curved pin hinged near ninety degrees of said bent end while extending substantially in parallel between said straight prongs.

7. A capo according to claim 6 wherein said pin has a plastically deformed curve, the apex of which first engages the strings in proximity of the center of the neck width of said instrument, while all of said prongs flex to substantially distribute uniform force to all of said strings.

8. A capo according to claim 4 wherein, said adjustable connection means comprises an eye screw threadably engaged in said spring and connected to said open end of said bar means.

9. A capo according to claim 8 comprising a tip sleeve over said open end of said wire form extending beyond said underlayment tube.

10. A capo according to claim 9 wherein, said tip sleeve comprises a flexible tailpiece attached to said open end of said wire form for threading through an eye of said eye screw to aid in stretching and engaging said spring with said open end of said hairpin during assembly of said capo to said neck.

11. A capo according to claim 1 wherein, said neck engagement means comprises a strip of selected material and width suitably attached in parallel relation to said neck along the apex of the transverse curve of said neck.

12. A capo according to claim 11 wherein, said neck engagement means comprises tape with adhesive backing for attachment to said neck.

* * * * *